US005755088A

United States Patent [19]

Farsetti

[11] Patent Number: 5,755,088

[45] Date of Patent: May 26, 1998

[54] METHOD OF FORMING A DECORATIVE CHAIN IN DUCTILE METAL WITH APPROXIMATELY SQUARE OR SIMILAR CROSS SECTION, AND CHAIN MADE IN THIS WAY

[75] Inventor: Franco Farsetti, Arezzo, Italy

[73] Assignee: Uno A Erre Italia S.p.A., Arezzo, Italy

[21] Appl. No.: 804,367

[22] Filed: Feb. 21, 1997

[30] Foreign Application Priority Data

Feb. 27, 1996 [IT] Italy ..... FI96A0034

[51] Int. Cl.[6] ..... B21L 15/00; B21L 17/00

[52] U.S. Cl. ..... 59/35.1; 59/28; 59/29; 59/30; 59/80

[58] Field of Search ..... 59/35.1, 28, 29, 59/80; D11/12, 13, 14

[56] References Cited

U.S. PATENT DOCUMENTS

| | | | |
|---|---|---|---|
| 2,200,828 | 5/1940 | Augenstein | 59/35.1 |
| 5,542,245 | 8/1996 | Lunardon | 59/35.1 |

FOREIGN PATENT DOCUMENTS

| | | | |
|---|---|---|---|
| 506631 | 9/1992 | European Pat. Off. | 59/80 |
| 248508 | 4/1926 | Italy | 59/80 |
| 274932 | 6/1930 | Italy | 59/80 |
| 685229 | 3/1965 | Italy | 59/80 |

*Primary Examiner*—David Jones
*Attorney, Agent, or Firm*—Hopgood, Calimafde, Kalil & Judlowe

[57] ABSTRACT

Starting with a helical chain of large links, of the type known as a "transverse figure-of-eight chain" or "transversely assembled figure-of-eight chain" that can be made by machine, after a preliminary twisting operation in which it is reduced to the general form of a strip with rounded edges, that is to say in the so-called "linx" chain configuration, a further deformation is carried out by swaging it in the direction of the greatest dimension of its cross section, in such a way that its cross section is deformed into a generally square figure.

8 Claims, 3 Drawing Sheets

Fig.9
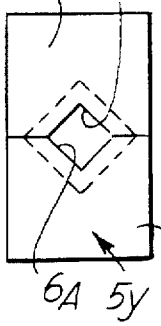
Fig.7
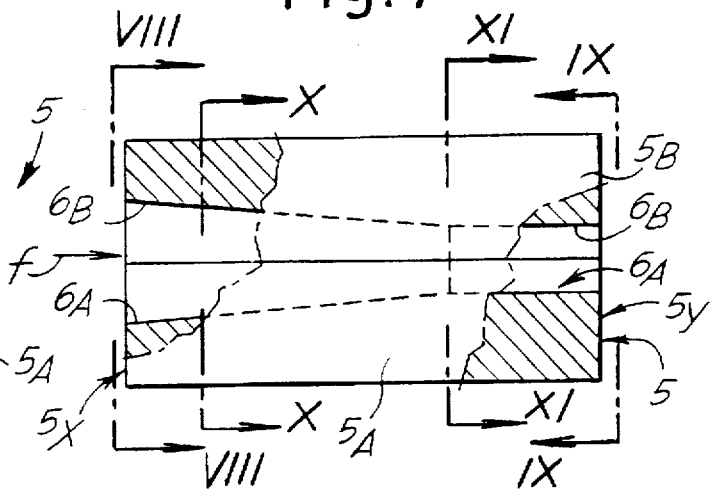
Fig.8
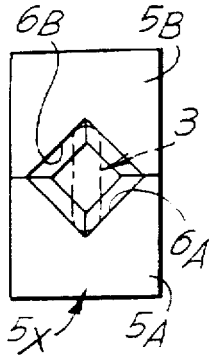
Fig. 10
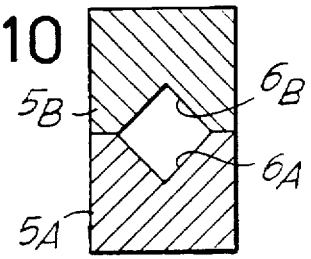
Fig.11
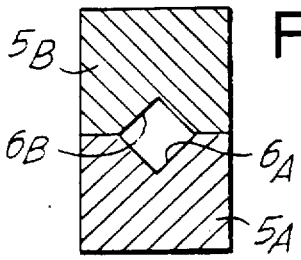
Fig.12
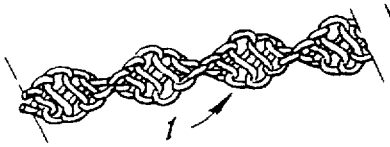
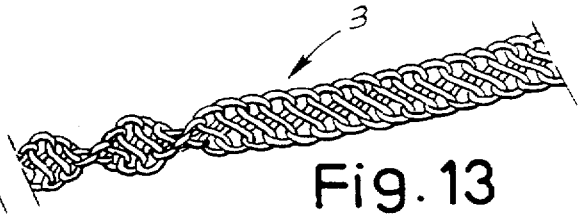
Fig.13
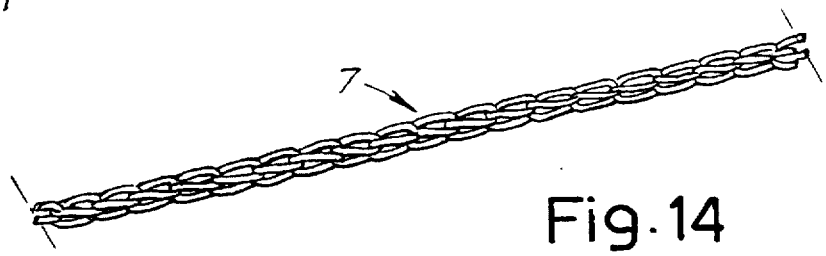
Fig.14

METHOD OF FORMING A DECORATIVE CHAIN IN DUCTILE METAL WITH APPROXIMATELY SQUARE OR SIMILAR CROSS SECTION, AND CHAIN MADE IN THIS WAY

Technical Field

The invention relates to a special method for converting a known type of machine-produced decorative chain into a decorative chain of different appearance and susceptible also of further processing.

BACKGROUND ART

Machine-produced chains having very loose links that cause a helical twisting of the chain are known. One such chain is known technically as a "transversely-assembled figure-of-eight chain" or "transverse figure-of-eight chain". Also known is the practice of modifying the shape of this chain by a process of flattening it, that is twisting it, to give a chain resembling a strip of only slightly convex cross section and only slightly rounded longitudinal edges, known technically as a "links chain".

DISCLOSURE OF THE INVENTION

The invention relates to another method of modifying the "links" chain, and also relates to a chain made by this method and a device for carrying the method out.

The method of the invention involves starting with a helical chain of large links, of the type known as a transverse figure-of-eight chain (that is, transversely assembled), and said method involves a preliminary flattening and/or twisting operation in which said transverse figure-of-eight chain is reduced to a chain generally resembling a strip with rounded edges, in the so-called "linx" chain configuration; after which there is another stage in which it is swaged in the direction of the greatest dimension of its cross section, by which means the cross section of the "linx" chain is deformed into a generally lozenge-shaped figure, which in one particular case may be square, or approximately square.

The method may also involve a subsequent superficial operation (making it into a diamond shape) of flattening the four faces and optionally chamfering one or at least some or all of the four longitudinal edges, to obtain a section with five or more up to eight edges.

The invention also includes a decorative chain in ductile metal, especially gold, made by the method described above. In essence this decorative chain consists of figure-of-eight links deformed so that the cross section of the chain is generally an approximately square lozenge.

A decorative chain made in this way may also have its faces flattened and also one or at least some or all four of its edges chamfered by removal of material.

The invention also relates to a device for carrying out the abovementioned method and for forming a chain as defined above. Said device comprises a swaging tool having two opposing dies, each with a through channel of generally V section that gradually tapers from the entrance end to the exit end. A "links" chain is presented at the entrance to the die—oriented in such a way as to position its edges, that is to say its longitudinal edges, in the vertex of each channel. By means of the swaging operation, therefore, and the advancing along the channels, the section of the chain is deformed to a shape corresponding to the final region of the section of the channels when the dies come together.

In one particular case, the V section of the channels, which varies along the length of the latter, may be such as to have an angular width of the vertex in the end region of the channels of about 90°, so that the final shape of the chain in cross section is a lozenge with angles of roughly 90° and thus in fact approximately square.

BRIEF DESCRIPTION OF THE DRAWINGS

The invention will be understood more clearly from an examination of the description and attached drawing, which latter shows a practical, non-restrictive embodiment of said invention. In the drawing:

FIGS. 7 through 11 show schematically a swaging tool for the operation of converting the chain from the appearance shown in FIGS. 2 and 8 to its appearance in FIGS. 3, 3A, 3B, 4 and 5; and FIGS. 12, 13 and 14 show views of the chain in the stages of the process.

DETAILED DESCRIPTION OF PREFERRED EMBODIMENT

Figure 1A:
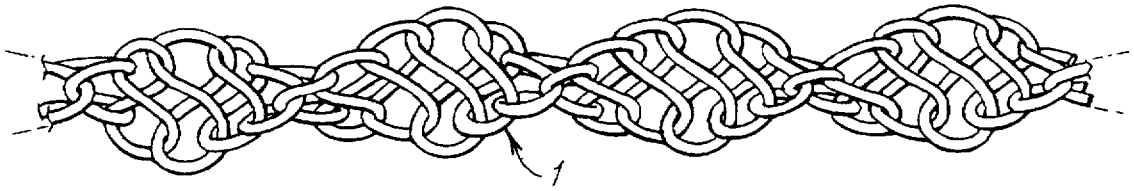
FIGS. 1A, 1B, 1C show the initial chain in schematic side view, in axial view and in certain details.
Figure 1B:
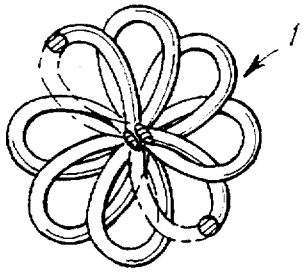
Figure 1C:
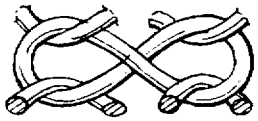
Figure 2:
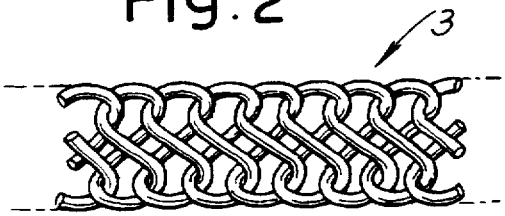
FIG. 2 shows the chain deformed into the "links chain" configuration.
Figure 3:
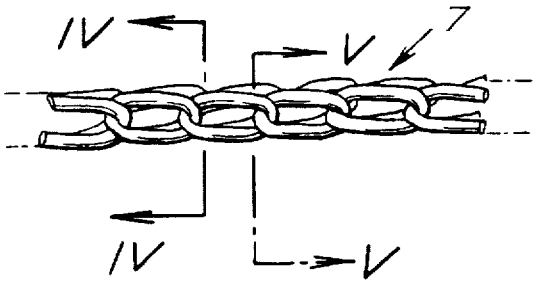
FIGS. 3, 3A and 3B show the chain after swaging.
Figure 3A:
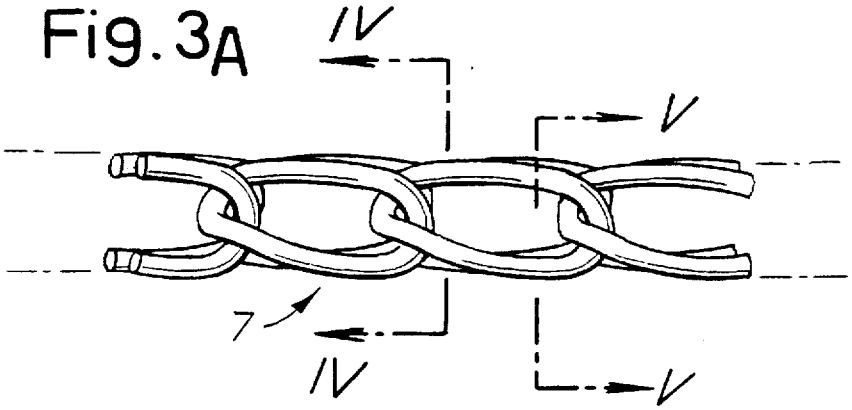
Figure 3B:
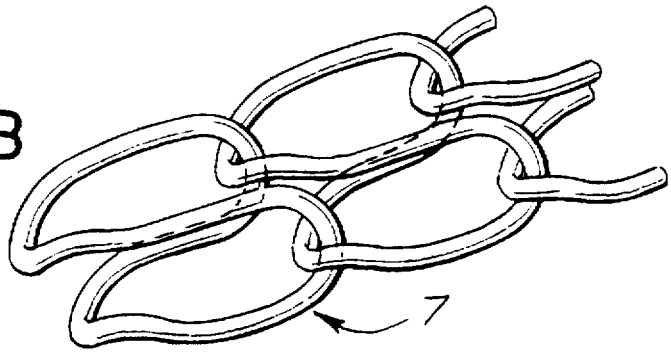

As illustrated in the drawing, the starting point is a so-called transversely-assembled figure-of-eight chain or, more simply, transverse figure-of-eight chain bearing the general reference 1 in FIGS. 1A, 1C and 12, which can be made by machines known in the precious metal industry for the manufacture of such chains. The chain 1 as it appears in said figures has a helical structure which can be modified by a process of straightening (twisting) it out of its helical structure into a flattened structure in which it appears as shown at 3 in FIGS. 2 and 13, by a transformation which in itself is already known for the making of decorative chains and which is known in the industry as the so-called "links" strip chain. This has a slightly more compact appearance than the chain 1 though without having undergone any particular thickening. The so-called "links" chain 3 in cross section is generally flat, that is, resembling a strip, with a slightly convex profile on its main faces and its longitudinal edges slightly rounded; the cross section of the "links" chain marked 3 is shown in dots and dashes in outline in FIG. 8.

The "links" chain marked 3 is further converted according to the invention into a chain 7 as shown schematically in FIGS. 3, 3A, 3B, 4, 5 and 14. The overall cross section of FIGS. 4 and 5 corresponds to the section of the practically square lozenge illustrated in FIG. 9. The conversion from the "links" chain appearance marked 3 to that marked 7 in FIGS. 3, 3A, 3B, 4, 5 and 14 is brought about by a swaging operation in a tool bearing the general reference 5 illustrated in FIGS. 7 through 11 to bring about a progressive deformation from the configuration of the section 3 marked in FIG. 8 to the configuration of the section 7 marked in FIGS. 4 and 5 corresponding to the negative configuration of the cavity of the tool 5 shown in FIG. 9. The tool 5 in practice is a die consisting of two half-dies 5A and 5B, each of which includes a V section channel 6A and 6B respectively, which tapers from the entrance end 5X to the exit end 5Y. The chain passes through this die following the arrow F shown in FIG.

7 and its section is progressively transformed from that of the "links" chain, i.e. of the portion marked 3, to that of the portion marked 7. The so-called "links" chain 3 is presented at the entrance 5X (FIGS. 7 and 8) with its structure oriented towards the vertices of the "V" channels 6A and 6B, that is to say in a vertical position when viewing FIG. 8 and the operation now commences of progressive swaging along the channels 6A and 6B, finishing up in the end section adjoining the exit 5Y (FIGS. 7 and 9) in which the chain 3 is deformed into the appearance 7 of FIGS. 3, 4 and 5, having therefore a lozenge structure which can eventually and in fact does reach a square cross section as shown in the drawing. The last section of the channels 6A and 6B is virtually constant in cross section in order to ensure finishing of the swaging deformation caused by the action of the two half-dies progressively by the progressive variation of cross section of the two channels 6A and 6B; the advancing of the chain occurs in the direction indicated by the arrow F in FIG. 7 and the chain is guided largely by the vertices of the two channels which ensure constant positioning of the chain throughout the deformation along the channels 6A and 6B of the die 5.

Figure 4:
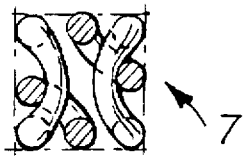
FIGS. 4 and 5 show two enlarged cross sections viewed on the planes marked IV—IV and V—V in FIGS. 3 and 3A.
Figure 5:
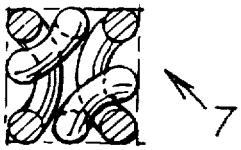

The chain 7 produced by the die 5 has a cross section like the exit cross section shown in FIG. 9 and as illustrated by the cross sections of FIGS. 4 and 5. Said chain may be used directly in the form obtained from the die, with optional superficial polishing treatment and with loosening of the links by traditional systems known in the art.

Figure 6A:
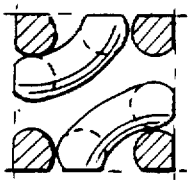
FIGS. 6A and 6B show, on a larger scale, a section through the chain of FIGS. 3 and 4, after a further operation, viz., respectively, two successive further operations of material removal.
Figure 6B:
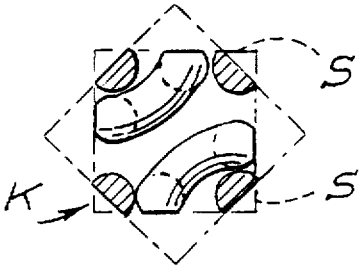

In addition, the chain may also undergo further treatments, e.g. before loosening-up of the links, in other words while the chain is still in its stiff condition produced by the swaging; in particular the chain 7 may undergo removal of material. Material may be removed from the faces of the cross section (see FIG. 6A) and/or from the four edges of the section to produce as many as eight edges and eight faces where material has been removed (see FIG. 6B) or along one or more of the four edges which are generated in the conversion brought about by the die 5 and by the flattening of the four faces. It is thus possible to arrive at a chain with a cross section as shown in FIG. 6B, in which the four edges S marked in broken lines in said FIG. 6B have been removed. This operation may also be limited to one or some of the edges S rather than to all four edges S as shown in FIG. 6B.

With the invention, a special shape of chain is produced by very simple and easily mechanized operations.

It will be understood that the drawing shows only an example purely by way of practical demonstration of the invention, it being possible for this invention to be varied as regards shapes and arrangements without thereby departing from the scope of the concept underlying the invention.

I claim:

1. A method of forming a decorative chain from a ductile metal which comprises:

providing a helically configurated transverse figure-of-eight chain, subjecting said helically configurated chain to a preliminary twisting operation and reducing the chain to a strip with rounded edges and having a link chain configuration with an enlarged cross section.

deforming said twisted chain by swaging it in the direction of its enlarged cross section, and thereby produce a deformed chain with four longitudinal faces and having a cross section in the shape of a lozenge of an approximately square configuration.

2. The method of claim 1, wherein the ductile metal is gold.

3. The method of claim 1, wherein said deformed chain is further superficially worked along the four longitudinal faces to provide a diamond shaped cross section, said method also including chamfering at least one of the longitudinal faces to form a section having at least one additional edge.

4. The method of claim 3, wherein additional longitudinal faces are chamfered to form up to eight edges.

5. The method of claim 2, including figure-of-eight links deformed so that the cross section comprises approximately square lozenges.

6. A decorative chain produced in accordance with the method of claim 4.

7. A device for forming a decorative chain comprising a swaging tool made up of two opposing dies, each of the dies having a V-shaped channel running therethrough, such that when the dies are brought together, the opening therethrough has cross section of an approximately square configuration.

8. The device as defined in claim 7, wherein the vertex of the V-shaped channels in the dies have an angle of approximately 90° in an end region of the channels.

* * * * *